US006993276B2

(12) United States Patent
Kamiya

(10) Patent No.: US 6,993,276 B2
(45) Date of Patent: Jan. 31, 2006

(54) BELT APPARATUS AND IMAGE FORMING APPARATUS HAVING THE SAME

(75) Inventor: Takuroh Kamiya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/855,741

(22) Filed: May 28, 2004

(65) Prior Publication Data

US 2005/0008407 A1 Jan. 13, 2005

(30) Foreign Application Priority Data

Jun. 26, 2003 (JP) ..... 2003-182789

(51) Int. Cl.
*G03G 15/01* (2006.01)

(52) U.S. Cl. ..... 399/302; 399/300; 399/303; 399/308; 399/396

(58) Field of Classification Search ..... 399/300, 399/302, 303, 308, 396; 198/835
See application file for complete search history.

(56) References Cited

U.S. PATENT DOCUMENTS

| | | | | |
|---|---|---|---|---|
| 3,308,929 | A * | 3/1967 | Shriver | 198/840 |
| 5,326,011 | A * | 7/1994 | Mager et al. | 226/181 |
| 5,507,382 | A * | 4/1996 | Hartwell et al. | 198/837 |
| 5,697,031 | A | 12/1997 | Kamiya et al. | |
| 6,418,287 | B1 * | 7/2002 | Jackson | 399/167 |
| 2003/0147678 | A1 * | 8/2003 | Ozawa et al. | 399/302 |

* cited by examiner

*Primary Examiner*—Arthur T. Grimley
*Assistant Examiner*—Peter Lee
(74) *Attorney, Agent, or Firm*—Oblon, Spivak, McClelland, Maier & Neustadt, P.C.

(57) ABSTRACT

A belt apparatus having an endless belt which is wound around and movably driven by a plurality of support rollers. The speed fluctuations of the endless belt due to the variations in thickness of the endless belt are prevented. A driving apparatus for driving the endless belt has a driving roller and an opposite roller facing with each other across the endless belt, and a driving motor for driving the driving roller, the driving roller and the opposite roller being in pressure contact with each other only at both end parts in their axial direction via the endless belt and the pressure contact part forming a plane.

18 Claims, 6 Drawing Sheets

FIG. 2A PPIOR ART
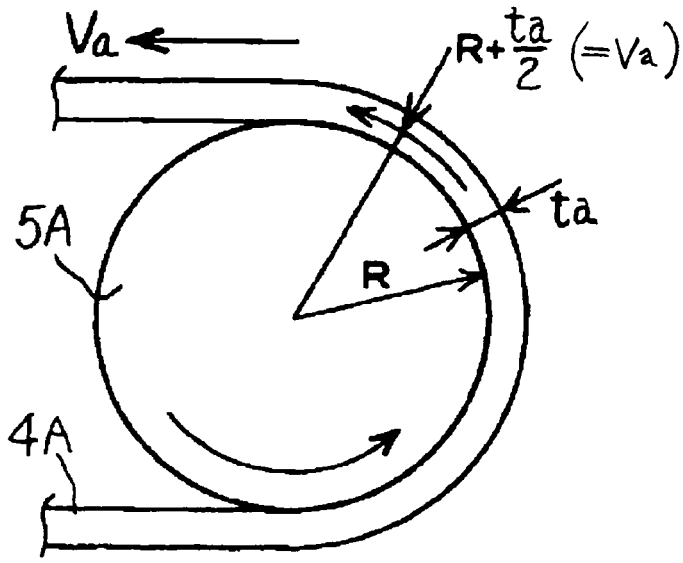
FIG. 2B PRIOR ART
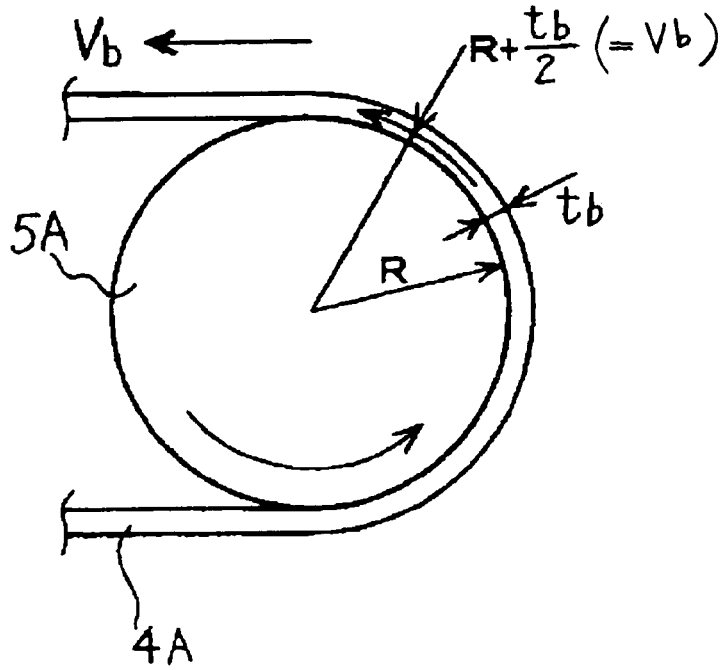

BELT APPARATUS AND IMAGE FORMING APPARATUS HAVING THE SAME

BACKGROUND OF THE INVENTION

1. Field of the Invention

The present invention relates to a belt apparatus having an endless belt which is wound around and movably driven by a plurality of support rollers, and an image forming apparatus having the belt apparatus.

2. Description of the Background Art

The above described belt apparatus is being widely used for mechanical apparatus in various technical fields. For example, in copiers, printers, facsimile machines, or image forming apparatuses which are configured as a combination unit of these mechanisms, an endless belt of such a belt apparatus is placed facing multiple photosensitive elements to transfer toner images, which are formed on each photosensitive element and have colors different from each other, one upon another onto a recording medium which is supported and conveyed by the driven endless belt described above, and the toner images are fixed on the recording medium by a fixing apparatus. Such a belt apparatus is disclosed in, for example, Japanese Patent No. 2,608,080 (PAGE 3, FIG. 1).

Also known is an image forming apparatus in which toner images formed on each photosensitive element and having colors different from each other are transferred one upon another onto an endless belt of a belt apparatus, and thereafter the toner images are transferred onto a recording medium and fixed on the recording medium by a fixing apparatus.

In conventional belt apparatuses such as described above, one of the support rollers having the endless belt wound thereon is configured as a driving roller, and the driving roller is rotatably driven by a driving source to move the endless belt. However, an endless belt inevitably has thick part and thin part due to the nature of its manufacturing method resulting in uneven thickness distribution in the circumferential direction, and therefore adopting the above described configuration will cause speed fluctuations of the endless belt.

When such speed fluctuations occur in the endless belt applications, various problems will result. For example, when the belt apparatus is adopted in an image forming apparatus described above, the fluctuations of the endless belt will cause a problem that color shifts occur in a superposed image, which is transferred onto a recording medium or the endless belt from a plurality of photosensitive elements, thereby degrading the image quality.

SUMMARY OF THE INVENTION

The object of the present invention is to provide a belt apparatus in which the speed fluctuations of the endless belt due to the deviations in its thickness are effectively suppressed, and an image forming apparatus having the belt apparatus.

In accordance with the present invention, there is provided a belt apparatus having an endless belt which is wound around and movably driven by a plurality of support rollers. The belt apparatus comprises a driving roller in which the driving apparatus to drive the endless belt is in abutment with one surface of the endless belt, a driving source for rotatably driving the driving roller, an opposite roller which is placed facing the driving roller across the endless belt and pressurizing means for contacting in pressure the driving roller with the opposite roller. The driving roller and the opposite roller hold the endless belt so that the part of the endless belt sandwiched between the driving roller and the opposite roller becomes a plane shape. The driving roller and the opposite roller are configured such that only both end parts in the axial direction are in contact under pressure with each other and the intermediate parts between both end parts are formed to have a smaller diameter so as not to contact the endless belt.

In accordance with the present invention, there is provided an image forming apparatus which comprises a belt apparatus having an endless belt which is wound around and movably driven by a plurality of support rollers, a plurality of photosensitive elements which are located facing the front face of the endless belt of the belt apparatus and on which toner images having colors different from each other are formed, a transfer apparatus for transferring the toner images formed on each photosensitive element onto a recording medium which is supported and conveyed by the endless belt and a fixing apparatus for fixing the toner images, which have been transferred onto the recording medium, on the recording medium. The belt apparatus comprises a driving source for rotatably driving the driving roller, an opposite roller which is placed facing the driving roller across the endless belt and pressurizing means for contacting in pressure the driving roller with the opposite roller. The driving roller and the opposite roller hold the endless belt so that the part of the endless belt sandwiched between the driving roller and the opposite roller becomes a plane shape, and the driving roller and the opposite roller are configured such that only both end parts in the axial direction are in contact under pressure with each other and the intermediate parts between both end parts are formed to have a smaller diameter so as not to contact the endless belt.

In accordance with the present invention, there is also provided an image forming apparatus which comprises a belt apparatus having an endless belt which is wound around and movably driven by a plurality of support rollers, a plurality of photosensitive elements which are placed facing the front face of the endless belt of the belt apparatus and on which toner images having colors different from each other are formed, a primary transfer apparatus for transferring the toner images formed on each photosensitive element onto the front face of the endless belt, a secondary transfer apparatus for transferring the toner images, which have been transferred onto the front face of the endless belt, onto a recording medium and a fixing apparatus for fixing the toner images, which have been transferred onto the recording medium, on the recording medium. The belt apparatus comprises a driving source for rotatably driving said driving roller, an opposite roller which is placed facing the driving roller across the endless belt and pressurizing means for contacting in pressure the driving roller with the opposite roller. The driving roller and the opposite roller hold the endless belt so that the part of the endless belt sandwiched between the driving roller and the opposite roller becomes a plane shape, and the driving roller and the opposite roller are configured such that only both end parts in the axial direction are in contact under pressure with each other and the intermediate parts between both end parts are formed to have a smaller diameter so as not to contact the endless belt.

BRIEF DESCRIPTION OF THE DRAWINGS

The above and other objects, features and advantages of the present invention will become more apparent from the following detailed description taken with the accompanying drawings in which:

FIGS. 2A and 2B are diagrams to illustrate that the thickness variations of the endless belt will cause speed fluctuations of the endless belt;

DESCRIPTION OF THE PREFERRED EMBODIMENTS

Figure 1:
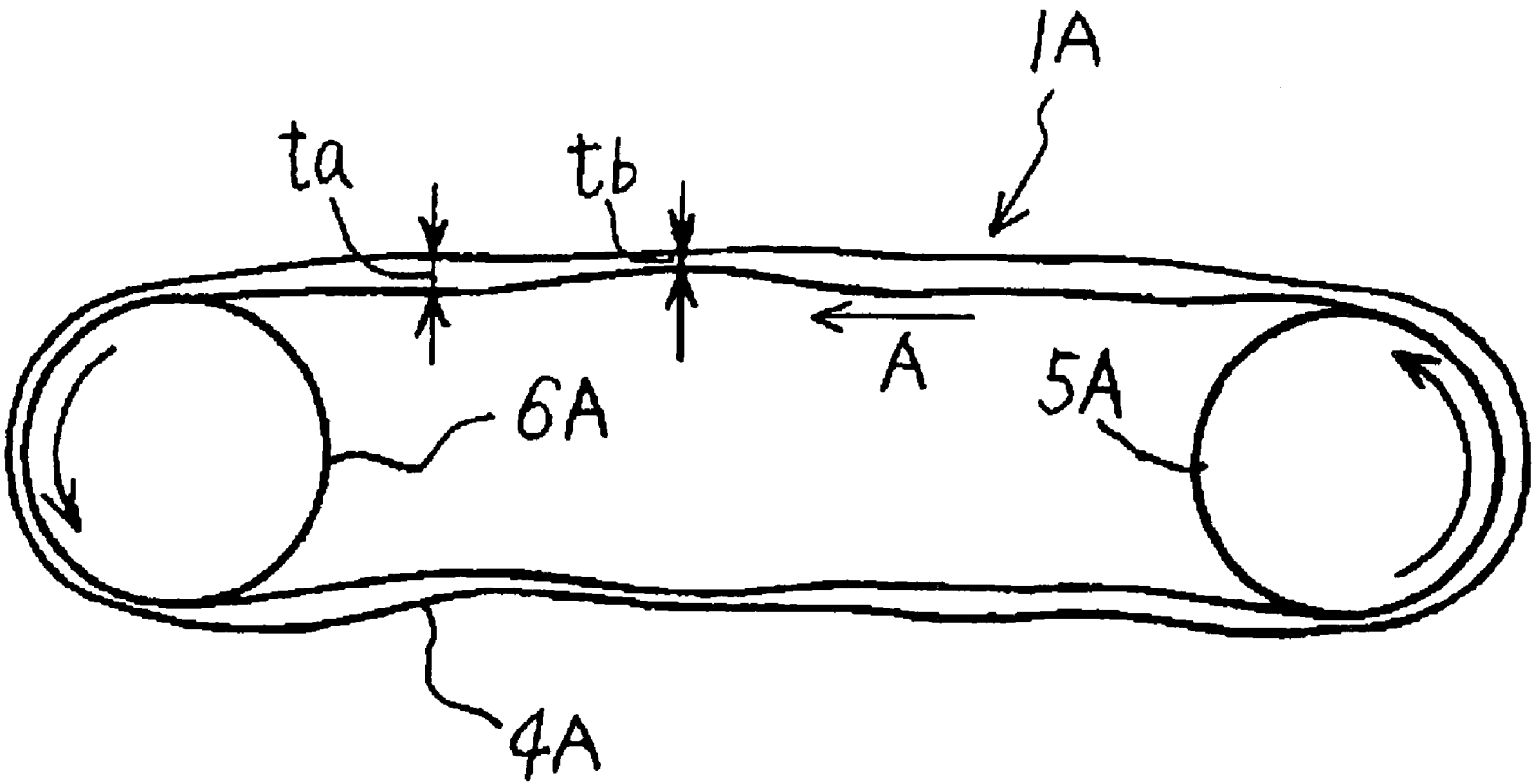
FIG. 1 PRIOR ART
FIG. 1 is a diagram to illustrate thickness variations of an endless belt.

Before describing the present invention, prior art and its problems will be described referring to the drawings.

As so far described, since the endless belt of a belt apparatus used in mechanisms of various technical fields, for example, in copiers, printers, facsimile machines, or image forming apparatuses configured as a combination unit of these mechanisms, inevitably has thick part and thin part due to the nature of its manufacturing method resulting in uneven thickness distribution in the circumferential direction, a problem arises in that the traveling speed of such endless belt fluctuates.

Referring to FIGS. 1, 2A and 2B, this problem will be described. The belt apparatus 1A shown in FIG. 1 has an endless belt 4A which is wound around two support rollers consisting of a driving roller 5A and a follower roller 6A, and the driving roller 5A is driven to rotate counter-clockwise by a driving motor which is not shown so that the endless belt 4A is driven to travel in the direction indicated by the arrow A and the follower roller 6A follows to rotate counter-clockwise. In this configuration, as exaggeratingly shown in FIG. 1, thick part ta and thin part tb are inevitably formed in the endless belt 4A.

FIG. 2A shows a state in which a thick part ta of the endless belt 4A is wound around the driving roller 5A, and FIG. 2B shows a state in which a thin part tb of the endless belt 4A is wound around the driving roller 5A, respectively. Typically, the surface speed of the endless belt 4A which is driven by the driving roller 5A is determined by (the radius R of the driving roller 5A+⅓ to ½ of the thickness of the endless belt) and the angular velocity of the driving roller 5A. With reference to ½ of the thickness of the endless belt, when the thick part ta of the endless belt 4A is wound around the driving roller 5A, the surface speed Va of the endless belt 4A is determined by (R+ta/2), and when the thin part tb of the endless belt is wound around the driving roller 5A, the surface speed V6 of the endless belt 4A is determined by (R+tb/2). An assumption that the angular velocity of the rotating driving roller 5A is constant will lead to a result, Va>Vb. One way to eliminate such speed fluctuations is to make the thickness of the endless belt 4A uniform; however, fully controlling the thickness of the belt is difficult in the viewpoint of its manufacturing and it cannot be helped that deviations in the thickness randomly occur.

If such speed fluctuations occurred in the endless belt, for example, if the speed of the endless belt adopted in an image forming apparatus as described above fluctuated, a problem existed in that color shifts occurred in the superposed toner images, which had been transferred onto a recording medium or the endless belt from a plurality of photosensitive elements, thereby degrading the image quality.

Hereinafter, one embodiment of the present invention which has solved the above described problem of the prior art will be described in detail referring to drawings.

Figure 3:
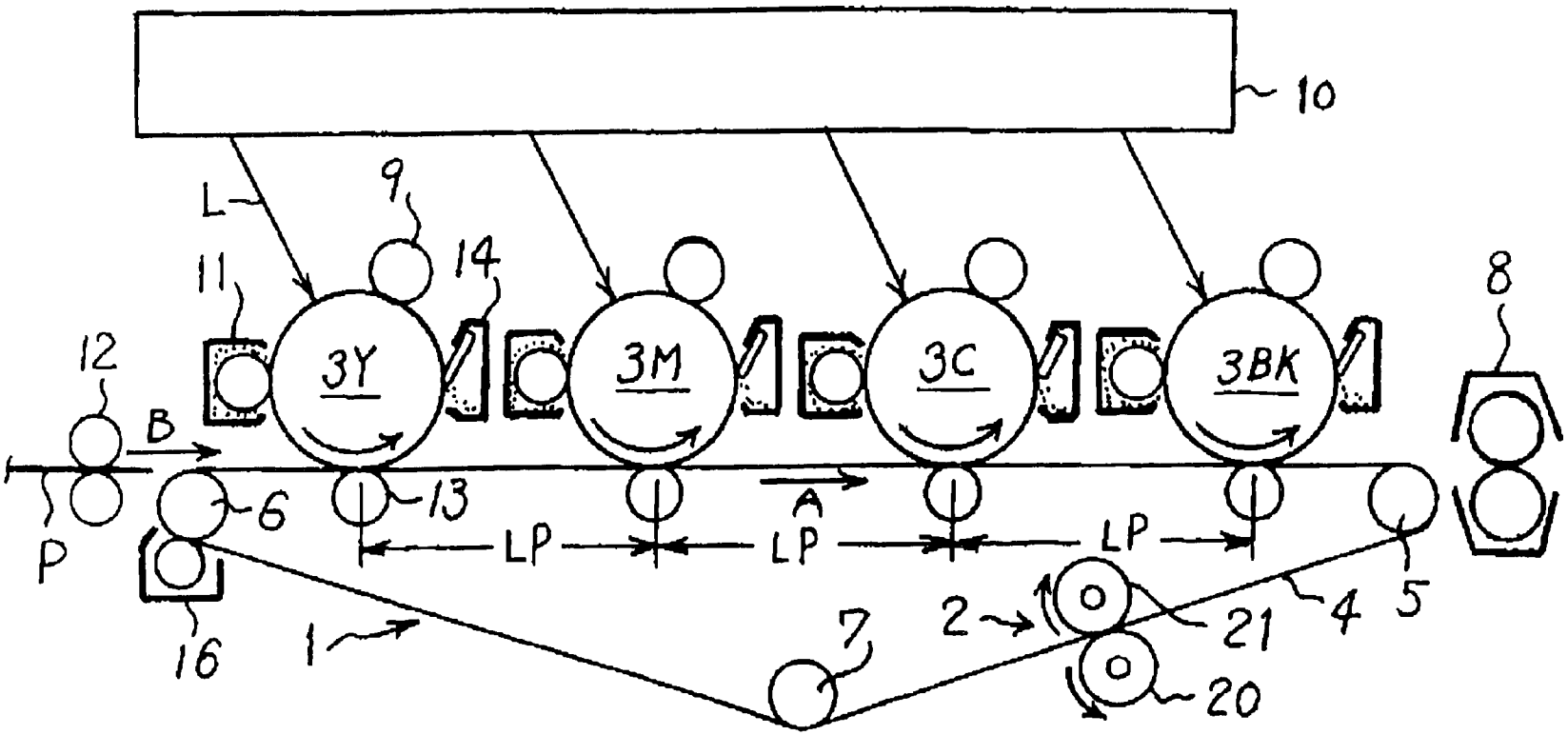
FIG. 3 is a partial sectional view to show a general configuration of an example of the direct-transfer type image forming apparatus according to the present invention.
Figure 4:
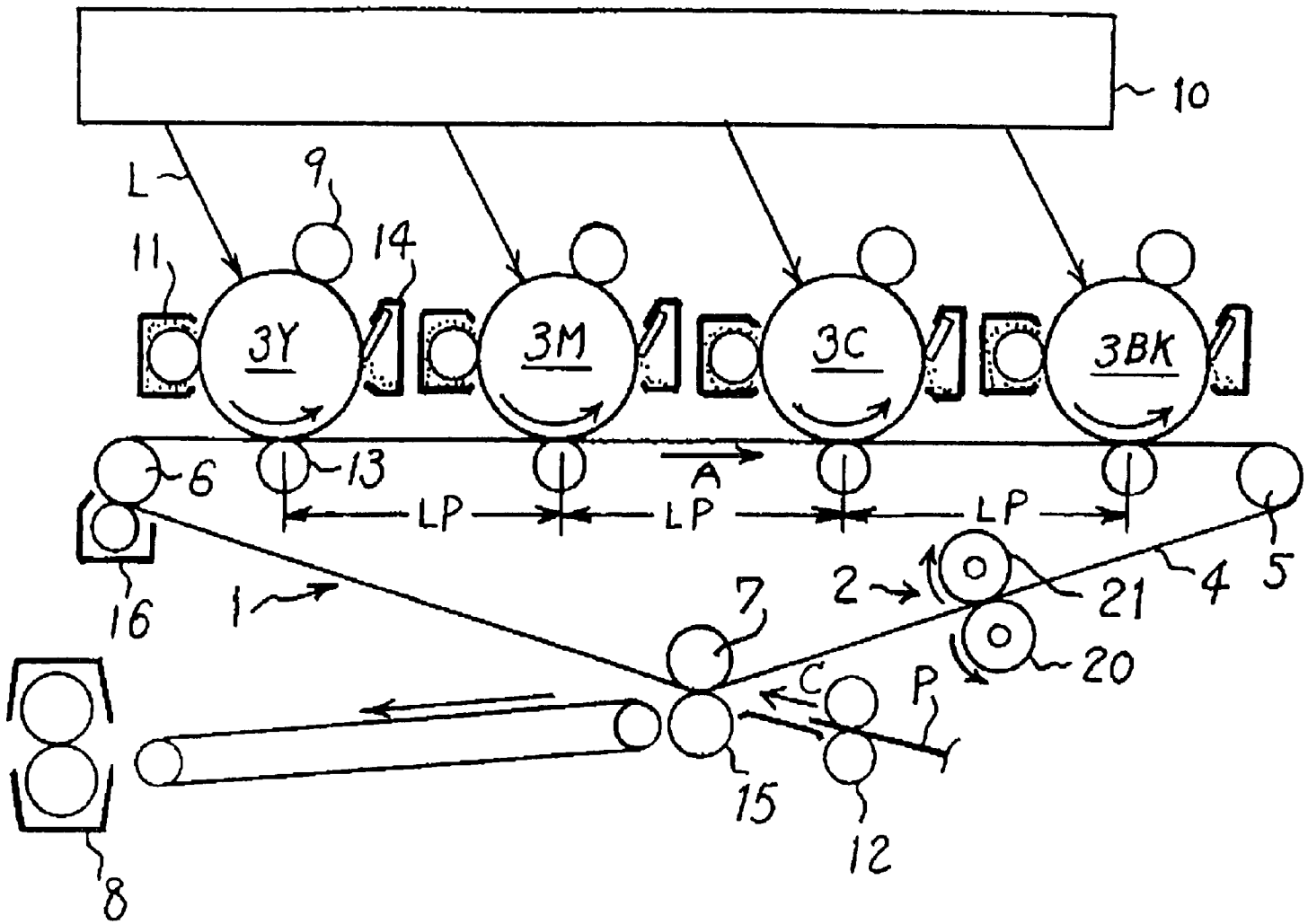
FIG. 4 is a partial sectional view to show a general configuration of an example of the intermediate-transfer type image forming apparatus according to the present invention.

FIGS. 3 and 4 respectively show a general configuration of each example of the image forming apparatuses having a belt apparatus according to the present embodiment. That is, FIG. 3 shows the configuration of a direct-transfer type image forming apparatus in which toner images formed on each photosensitive element are directly transferred onto the recording medium supported and conveyed by the endless belt, and FIG. 4 shows the configuration of an intermediate-transfer type image forming apparatus in which toner images formed on each photosensitive element are transferred onto the endless belt of the belt apparatus and then the toner images are transferred onto a recording medium, respectively. First, configurations which are common to these image forming apparatuses will be described.

The image forming apparatuses shown in FIGS. 3 and 4 have a belt apparatus 1, and a plurality of photosensitive elements 3Y, 3M, 3C, 3BK which are formed in a drum shape. The belt apparatus 1 has an endless belt 4 which is wound around a plurality of support rollers 5, 6, 7 and travels in the direction of arrow A by being driven by a driving apparatus 2 to be described later. The plurality of the photosensitive elements 3Y to 3BK are placed facing the front face of the endless belt 4 of the belt apparatus 1 and toner images having colors different from each other are formed on each of the photosensitive elements 3Y to 3BK. In the illustrated examples, configuration is such that a yellow toner image, a magenta toner image, a cyan toner image and a black toner image are formed on the front face of each photosensitive element 3Y to 3BK, respectively.

Since the configuration for forming a toner image on each photosensitive element 3Y to 3BK is substantially the same for any photosensitive element, only the configuration for forming a toner image on the photosensitive element 3Y will be described. This photosensitive element 3Y is driven to rotate counter-clockwise in FIGS. 3 and 4 and, at this time, the front face of the photosensitive element 3Y is charged with a predetermined polarity by a charging apparatus 9. Then, the charged front face is irradiated with writing light (laser light L in the illustrated examples) emitted from a light exposure apparatus 10 thereby forming an electrostatic latent image on the photosensitive element 3Y, the electrostatic latent image being visualized as a toner image by a developing apparatus 11.

In the direct-transfer type image forming apparatus shown in FIG. 3, a recording medium P consisting of transfer paper or plastic film, etc. is fed from a paper feed part (not shown) into between the photosensitive element 3Y and the endless belt 4, which travels in the direction of arrow A in abutment with the photosensitive element 3Y, caused by the rotation of the resist-roller pair 12 at a predetermined timing, and the recording medium P is supported and conveyed by the endless belt 4. A transfer apparatus 13 is disposed at a position substantially facing the photosensitive element 3Y across the endless belt 4, and the transfer apparatus 13 is applied with a transfer voltage having an opposite polarity to the toner charge polarity of the toner image on the photosensitive element 3Y thereby transferring a yellow toner image formed on the photosensitive element 3Y onto the recording medium P. The transfer remnant toner left on the photosensitive element 3Y without being transferred onto the recording medium P is removed by a cleaning apparatus 14.

In an exactly like manner, a magenta toner image, a cyan toner image and a black toner image are formed respectively on other photosensitive elements shown in FIG. 3, and these toner images are successively transferred one upon another onto the recording medium P onto which the yellow toner image has been transferred. The recording medium P which thus carries a four-color composite. toner image passes through the fixing apparatus 8 after departing from the endless belt 4, and at this time, the toner image is fixed on the recording medium by the action of heat and pressure. In FIG. 3, a belt cleaning apparatus for removing the toner deposited on the endless belt 4 is denoted by numeral 16.

As described above, this direct-transfer type image forming apparatus comprises a transfer apparatus 13 for transferring the toner image formed on each photosensitive element 3Y to 3BK onto the recording medium P which is supported and conveyed by the endless belt 4, and also comprises a fixing apparatus 8 for fixing the toner images, which have been transferred onto the recording medium, on the foregoing recording medium P.

On the other hand, in the intermediate-transfer type image forming apparatus shown in FIG. 4, the yellow toner image formed on the photosensitive element 3Y is transferred onto the front face of the endless belt 4, which is driven to travel in the direction of arrow A, by the action of the primary transfer apparatus 13. The transfer remnant toner deposited on the photosensitive element 3 after the transfer of toner images is removed by the cleaning apparatus 14. In an exactly like manner, a magenta toner image, a cyan toner image and a black toner image formed respectively on other photosensitive elements 3M, 3C, 3BK are successively transferred one upon another onto the front face of the recording medium P onto which the yellow toner image has been transferred. Thus, a four-color composite toner image is formed on the endless belt 4.

Also as shown in FIG. 4, a secondary transfer apparatus 15 is disposed facing the support roller 7 across the endless belt 4, and the recording medium P consisting of transfer paper or plastic film, which has been fed out from a paper feed part (not shown), is fed into between the secondary transfer apparatus 15 and the endless belt 4, as shown by arrow C, caused by the rotation of the resist-roller pair 12 at a predetermined timing. At this time, the secondary transfer apparatus 15 is applied with a transfer voltage having an opposite polarity to the toner charge polarity of the toner image on the endless belt 4, and the toner images on the endless belt 4 are transferred by one operation onto the recording medium P when the recording medium P passes through the secondary transfer apparatus 15. The transfer remnant toner deposited on the front face of the endless belt 4 after the transfer of toner images is removed by the belt cleaning apparatus 16. The recording medium P onto which toner images have been transferred also passes through the fixing apparatus 8 and, at this time, the transferred toner images are fixed on the recording medium P by the action of heat and pressure.

As described above, this intermediate-transfer type image forming apparatus comprises a primary transfer apparatus 13 for transferring the toner images formed on each photosensitive element 3Y to 3BK onto the front face of the endless belt 4, a secondary transfer apparatus 15 for transferring the toner images formed on the front face of the endless belt 4 onto the recording medium P, and a fixing apparatus 8 for fixing the toner images transferred onto the recording medium P on the recording medium P.

Next, the driving apparatus for driving the endless belt 4 will be described.

Figure 5:
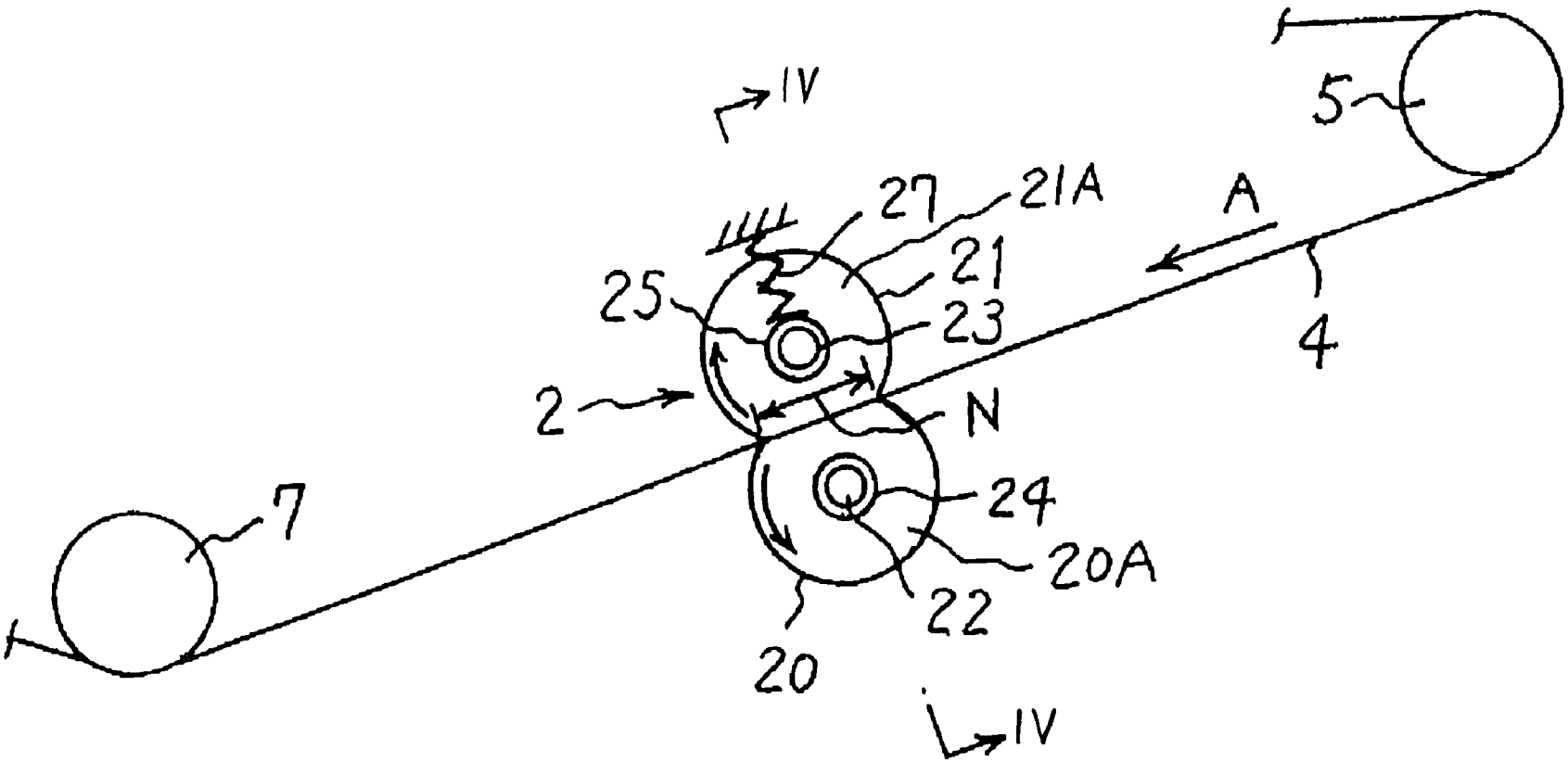
FIG. 5 is a diagram to show the configuration of part of the image forming apparatus shown in FIGS. 3 and 4.
Figure 6:
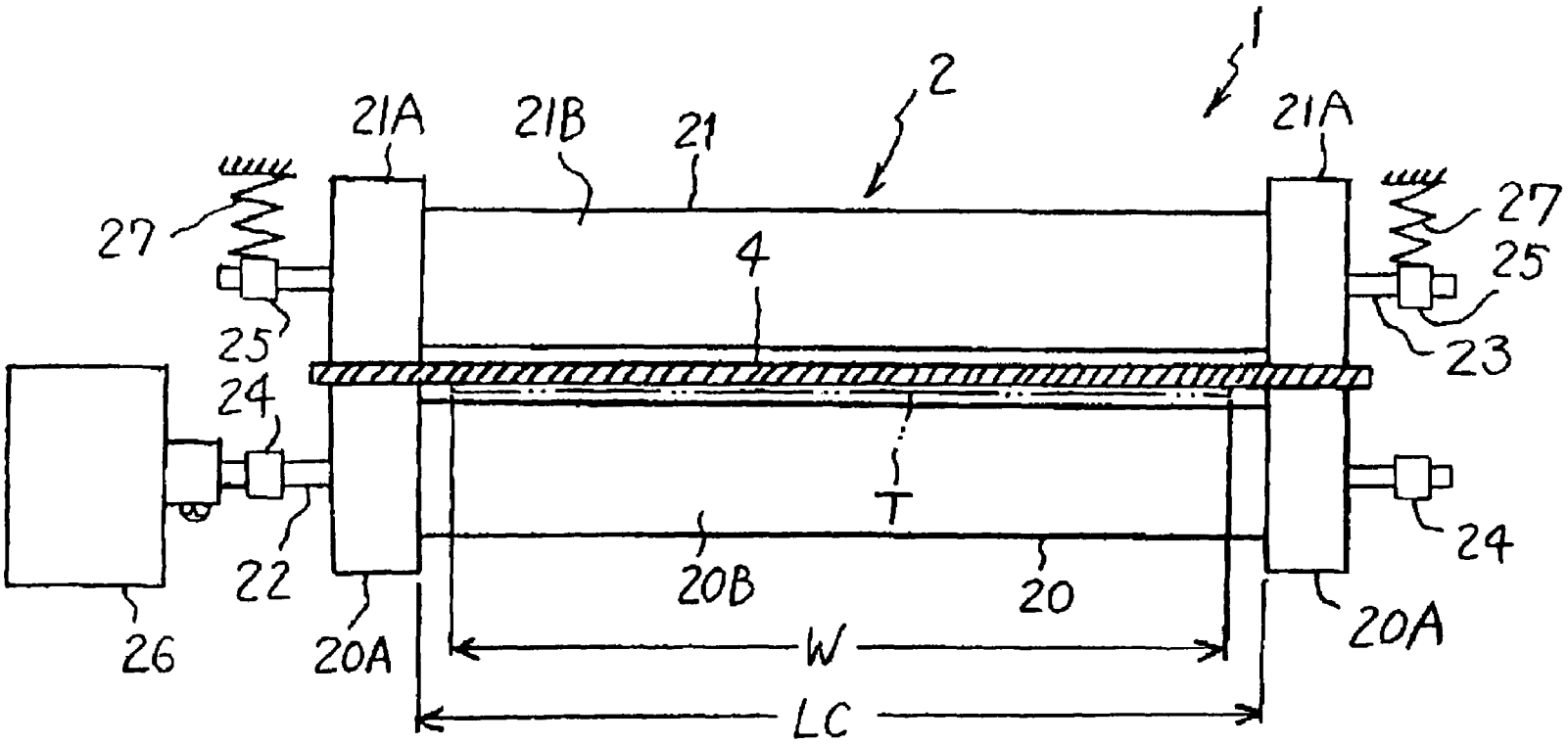
FIG. 6 is a sectional view taken along the line VI—VI in FIG. 5.

As shown in FIGS. 5 and 6, the driving apparatus 2 has a driving roller 20 which is in abutment with one surface of the endless belt 4, front face in the illustrated example, and an opposite roller 21 which is disposed facing the driving roller 20 across the endless belt 4, these rollers 20, 21 extending in the width direction of the endless belt 4 and being placed substantially parallel with each other. The driving roller 20 and opposite roller 21 are fixedly supported by the axes 22, 23 respectively and each end of the axes 22, 23 is rotatably supported with respect to the main body of the image forming apparatus via the bearings 24, 25. Also the axis 22 is rotatably driven by the driving motor 26 connected thereto thereby rotating the driving roller counter-clockwise in FIGS. 3 to 5. Also each bearing 25 is pressurized by pressurizing means consisting of a compression spring 27 so that the opposite roller 21 and the driving roller 20 are in contact under pressure with each other via the endless belt 4. Thus, the driving apparatus 2 has a driving motor 26 which is an example of the driving source to rotatably drive the driving roller 20, and pressurizing means to make the driving roller 20 and the opposite roller 21 be in contact under pressure with each other via the endless belt 4.

Also, as seen from FIG. 6, the driving roller 20 and the opposite roller 21 are in contact under pressure with each other via the endless belt 4 only at both end parts 20A, 21A in their axial direction, and intermediate parts 20B, 21B between both end parts 20A, 21A are configured to have a smaller diameter than both end parts 20A, 21A so as not to come into contact with the endless belt 4. Further, FIG. 5 shows a state in which the end parts 20A and 21A of the driving roller 20 and the opposite roller 21 are in contact under pressure with each other via the endless belt 4 causing the end parts 20A and 21A to be deformed elastically thereby forming a nip N in the pressure contact part; on the other hand, FIGS. 3, 4, and 6, show a state in which both end parts 20A, 21A which are in contact under pressure with each other are not deformed.

Also, as seen from FIG. 5, the driving roller 20 and the opposite roller 21 hold the endless belt 4 therebetween so that the part of the endless belt 4 sandwiched between the driving roller 20 and the opposite roller 21 has a plane shape. That is, the nip N formed in the pressure contact part of both end parts 20A, 21A has a linear shape. More specifically, the driving roller 20 and the opposite roller 21 are specified to have an approximately same radius and hardness. Typically, the driving roller 20 and the opposite roller 21 are made of the same material. Moreover, both end parts 20A, 21A of the both rollers 20, 21 hold the part of the endless belt which is stretched in a plane shape. In the examples shown in FIGS. 3 to 5, part of the endless belt stretched in a plane shape between the two support rollers 5, 7 is held between both ends 20A, 21A of the driving roller 20 and the opposite roller 21. Such a configuration makes it possible to make the part of the endless belt sandwiched between the driving roller 20 and the opposite roller 21 to be a plane-shape.

Operation of the driving motor 26 shown in FIG. 6 drives the driving roller 20 to rotate counter-clockwise as shown in FIGS. 3 to 5, and thereby the endless belt 4 is driven to travel in the direction of arrow A since there is friction generated between both end parts 20A of the driving roller 20 and the endless belt 4 which is in contact under pressure therewith. At this time, the opposite roller 21 and the support rollers 5, 6, 7 follow to rotate clockwise as shown in FIGS. 3 and 4 respectively. Since, at this moment, the part of the endless belt sandwiched between the driving roller 20 and the opposite roller 21 becomes a plane shape and the nip N forms a straight line along the traveling direction of the endless belt 4, the speed fluctuations of the endless belt 4 can be suppressed even if there are deviations in the thickness of the endless belt 4 as described referring to FIG. 1 thus making it possible to substantially eliminate the speed fluctuations of the endless belt 4 due to the variation in the thickness of the endless belt 4. Thus, it is made possible to prevent the occurrence of color shifts in a composite toner image transferred onto the recording medium P or the endless belt 4 caused by the deviations in the thickness of the endless belt 4.

Also, by specifying the perimeter of both end part 20A of the driving roller 20 to be approximately 1/n (n is integer not smaller than 1) of the distance LP from the each photosensitive element 3Y to 3BK shown in FIGS. 3 and 4 to the position at which toner images are transferred to the recording medium P or the endless belt 4, it is also made possible to prevent color shifts caused by the speed fluctuations of the driving roller 20 due to such as off-centering of the driving roller 20, thereby further improving the image quality of the completed color image.

The driving roller 20 and the opposite roller 21 can be placed at any position in the circumferential direction of the endless belt 4 provided that the position is in the plane-shape part of the endless belt 4 and will not interfere with other elements. In the example shown in FIG. 4, the driving roller 20 and the opposite roller 21 are placed in the part of the endless belt which is in the downstream of the primary transfer position, at which the toner images are transferred from the photosensitive element 3BK located in the furthest downstream with respect to the moving direction of the endless belt 4 to the endless belt 4, and in the upstream of the secondary transfer position, at which the toner images on the endless belt 4 are transferred onto the recording medium P. Therefore, toner images transferred onto the front face of the endless belt 4 pass through between the driving roller 20 and the opposite roller 21. In FIG. 6, this toner image is shown by a chain line and denoted by symbol T. In this case, the driving roller 20 and the opposite roller 21 are in abutment with the endless belt 4 only at their both end parts 20A, 21A, and their intermediate parts 20B, 21B are not in abutment with the endless belt 4. Moreover, since the length of the intermediate part 20B of the driving roller which do not contact the endless belt 4 is larger than the width W of the toner image forming region of the endless belt 4, there is no risk that the driving roller 20 contacts the toner image T thereby disturbing the toner image T. This is also true with the case in which the opposite roller 21 is located on the front face side of the endless belt 4 on which the toner images are formed and the driving roller 20 is located on the back face side of the endless belt 4, and there is no risk that the opposite roller 21 disturbs the toner images on the endless belt 4. Just as well, when the endless belt 4 is configured as a belt on which front face the toner image T is formed, the length LC of the intermediate parts 20B, 21B, which are not in contact with endless belt, of the driving roller 20 or the opposite roller 12 which are located facing the front face of the endless belt 4 on which the toner image T is formed, is specified to be larger than the width W of the toner image forming region of the endless belt 4.

As described above, according to the belt apparatus 1 of the present embodiment, both for the case in which the endless belt 4 is a belt on which toner images are formed and for the case in which the endless belt 4 is a belt on which toner images are not formed, it is possible to increase the flexibility in arranging the driving roller 20 and the opposite roller 21 thereby increasing the design flexibility of the image forming apparatus.

Further, even if a foreign matter is deposited in the central region in the width direction of the endless belt, since this will not come into contact with both end parts 20A, 21A of the driving roller 20 and the opposite roller 21, the nip N of both end parts can be kept straight thereby making it possible to effectively prevent the occurrence of speed fluctuations of the endless belt 4.

As described so far, according to the present invention, it is possible to effectively suppress speed fluctuations of the endless belt caused by deviations in the thickness of the endless belt.

Various modifications will become Possible for those skilled in the art after receiving the teachings of the present disclosure without departing from the scope thereof.

What is claimed is:

1. A belt apparatus, comprising:

a plurality of support rollers;

an endless belt wound around the plurality of support rollers and configured to be movably driven around the plurality of support rollers;

a driving roller configured to drive said endless belt; and an opposite roller positioned facing said driving roller across the endless belt, wherein each of the driving roller and the opposite roller includes a first end portion at a first end thereof, a second end portion at a second end thereof opposite the first end, and an intermediate portion between the first end portion and the second end portion, said intermediate portion having a diameter smaller than that of the first end portion and the second end portion, and wherein said driving roller and the opposite roller hold the endless belt such that a part of the endless belt held and sandwiched between said driving roller and the opposite roller retains a uniform thickness distribution, and only the first end portions and the second end portions of the driving roller and the opposite roller are in contact under pressure with each other via the endless belt.

2. The belt apparatus as claimed in claim 1, wherein the first end portions and the second end portions of said driving roller and the opposite roller are specified to have approximately same radius and hardness, and hold the part of the endless belt stretching in a plane shape therebetween.

3. The belt apparatus as claimed in claim 1, wherein toner images are formed on a surface in a toner forming region of said endless belt, and a length of the intermediate portion of the driving roller or the opposite roller facing the surface of the endless belt on which the toner images are formed is set to be larger than a width of the toner forming region of the endless belt.

4. The belt apparatus as claimed in claim 1, further comprising:

a driving source configured to rotatably drive the driving roller; and means for pressurizing the opposite roller against the endless belt.

5. The belt apparatus as claimed in claim 1, wherein the part of the endless belt held and sandwiched between the driving roller and the opposite roller has a plane shape.

6. The belt apparatus as claimed in claim 1, wherein the driving roller and the opposite roller extend in a width direction of the endless belt and are positioned substantially parallel with each other.

7. An image forming apparatus comprising:

a belt apparatus;

an endless belt wound around a plurality of support rollers and configured to be movably driven around the plurality of support rollers;

a plurality of photosensitive elements positioned facing a surface of said endless belt on which toner images having colors different from each other are formed;

a transfer apparatus configured to transfer the toner images formed on each photosensitive element onto a recording medium conveyed by said endless belt; and a fixing apparatus configured to fix the toner images, which have been transferred onto the recording medium, on said recording medium, wherein said belt apparatus comprises:

said plurality of support rollers;

said endless belt wound around the plurality of support rollers and configured to be movably driven around the plurality of support rollers;

a driving roller configured to drive said endless belt; and an opposite roller positioned facing said driving roller across the endless belt, wherein each of the driving roller and the opposite roller includes a first end portion at a first end thereof, a second end portion at a second end thereof opposite the first end, and an intermediate portion between the first end portion and the second end portion, said intermediate portion having a diameter smaller than that of the first end portion and the second end portion, and wherein said driving roller and the opposite roller hold the endless belt such that a part of the endless belt held and sandwiched between said driving roller and the opposite roller retains a uniform thickness distribution, and only the first end portions and the second end portions of the driving roller and the opposite roller are in contact under pressure with each other via the endless belt.

8. The image forming apparatus as claimed in claim 7, wherein the first end portions and the second end portions of said driving roller and the opposite roller are specified to have approximately same radius and hardness, and hold the part of the endless belt stretching in a plane shape therebetween.

9. The image forming apparatus as claimed in claim 7, wherein toner images are formed on the surface in a toner forming region of said endless belt, and a length of the intermediate portion of the driving roller or the opposite roller facing the surface of the endless belt on which the toner images are formed is set to be larger than a width of the toner forming region of the endless belt.

10. The image forming apparatus as claimed in claim 7, wherein the belt apparatus further comprises:

a driving source configured to rotatably drive the driving roller; and means for pressurizing the opposite roller against the endless belt.

11. The image forming apparatus as claimed in claim 7, wherein the part of the endless belt held and sandwiched between the driving roller and the opposite roller has a plane shape.

12. The image forming apparatus as claimed in claim 7, wherein the driving roller and the opposite roller extend in a width direction of the endless belt and are positioned substantially parallel with each other.

13. An image forming apparatus comprising: a belt apparatus;

an endless belt wound around a plurality of support rollers and configured to be movably driven around the plurality of support rollers;

a plurality of photosensitive elements positioned facing a surface of the endless belt on which toner images having colors different from, each other are formed;

a primary transfer apparatus configured to transfer the toner images formed on each photosensitive element onto the surface of said endless belt;

a secondary transfer apparatus configured to transfer the toner images, which have been transferred onto said surface of the endless belt, onto a recording medium; and a fixing apparatus configured to fix the toner images, which have been transferred onto said recording medium, on said recording medium, wherein said belt apparatus comprises:

said plurality of support rollers;

said endless belt wound around the plurality of support rollers and configured to be movably driven around the plurality of support rollers;

a driving roller configured to drive said endless belt; and an opposite roller positioned facing said driving roller across the endless belt, wherein each of the driving roller and the opposite roller includes a first end portion at a first end thereof, a second end portion at a second end thereof opposite the first end, and an intermediate portion between the first end portion and the second end portion, said intermediate portion having a diameter smaller than that of the first end portion and the second end portion, and wherein said driving roller and the opposite roller hold the endless belt such that a part of the endless belt held and sandwiched between said driving roller and the opposite roller retains a uniform thickness distribution, and only the first end portions and the second end portions of the driving roller and the opposite roller are in contact under pressure with each other via the endless belt.

14. The image forming apparatus as claimed in claim 13, wherein the first end portions and the second end portions of said driving roller and the opposite roller are specified to have approximately same radius and hardness, and hold the part of the endless belt stretching in a plane shape therebetween.

15. The image forming apparatus as claimed in claim 13, wherein toner images are formed on the surface in a toner forming region of said endless belt, and a length of the intermediate portion of the driving roller or the opposite roller facing the surface of the endless belt on which the toner images are formed is set to be larger than a width of the toner forming region of the endless belt.

16. The image forming apparatus as claimed in claim 13, wherein the belt apparatus further comprises:

a driving source configured to rotatably drive the driving roller; and means for pressurizing the opposite roller against the endless belt.

17. The image forming apparatus as claimed in claim 13, wherein the part of the endless belt held and sandwiched between the driving roller and the opposite roller has a plane shape.

18. The image forming apparatus as claimed in claim 13, wherein the driving roller and the opposite roller extend in a width direction of the endless belt and are positioned substantially parallel with each other.

* * * * *